US005662431A

United States Patent [19]

Colvard

[11] Patent Number: 5,662,431

[45] Date of Patent: Sep. 2, 1997

[54] SELF-PROPELLED SLIP-FORM PAVING APPARATUS

[75] Inventor: John C. Colvard, Wilkesboro, N.C.

[73] Assignee: Power Curbers, Inc., Salisbury, N.C.

[21] Appl. No.: 549,564

[22] Filed: Oct. 27, 1995

[51] Int. Cl.[6] ..... E01C 19/12; E01C 11/22

[52] U.S. Cl. ..... 404/105; 404/98

[58] Field of Search ..... 404/98, 101, 96, 404/105; 403/326, 321, 322

[56] References Cited

U.S. PATENT DOCUMENTS

| | | | |
|---|---|---|---|
| 1,846,138 | 2/1932 | Moore . | |
| 2,953,977 | 9/1960 | Warren . | |
| 2,954,241 | 9/1960 | Warren . | |
| 3,489,431 | 1/1970 | McKeon et al. . | |
| 3,710,695 | 1/1973 | Miller et al. . | |
| 4,197,032 | 4/1980 | Miller | 404/98 |
| 4,391,549 | 7/1983 | Murray | 404/98 X |
| 4,566,823 | 1/1986 | May | 404/98 |
| 4,632,595 | 12/1986 | Schaeff . | |
| 4,701,069 | 10/1987 | Whitney . | |
| 4,789,266 | 12/1988 | Clarke, Jr. et al. . | |
| 4,808,026 | 2/1989 | Clarke, Jr. et al. . | |
| 4,810,162 | 3/1989 | Foster . | |
| 4,881,867 | 11/1989 | Essex et al. . | |
| 4,887,680 | 12/1989 | Nozaka et al. . | |
| 4,900,185 | 2/1990 | Foertsch . | |
| 4,984,932 | 1/1991 | Leone | 404/98 X |
| 4,994,628 | 2/1991 | Huldén . | |
| 4,997,333 | 3/1991 | Ball et al. . | |
| 5,050,684 | 9/1991 | Vollmer . | |
| 5,173,005 | 12/1992 | Henderson et al. | 404/105 X |
| 5,332,353 | 7/1994 | Arnold . | |
| 5,354,189 | 10/1994 | McKinnon | 404/98 X |
| 5,527,129 | 6/1996 | McKinnon | 404/98 |

FOREIGN PATENT DOCUMENTS

| | | | |
|---|---|---|---|
| 27386 | 10/1972 | Australia | 404/105 |

OTHER PUBLICATIONS

Barone, Inc. advertisement, Jul. 1995 (or earlier).

Wirtgen GmbH brochure, "Slip form paver SP 250 and SP 500", Apr. 1994, 16 pages.

*Primary Examiner*—Tamara L. Graysay
*Assistant Examiner*—Frederick L. Lagman
*Attorney, Agent, or Firm*—Shefte, Pinckney & Sawyer

[57] ABSTRACT

The present invention provides a novel arrangement for selective mounting and demounting of a mold to a self-propelled slip-form paving machine. The paving machine basically comprises a frame, a drive engine, a hopper for concrete or another suitably flowable paving material and the aforementioned mold in the desired configuration of the pavement (curb, gutter, etc.) to be formed. The mounting and demounting arrangement comprises a set of hydraulically pivotable latching levers which engage with latching bars on the mold for quickly coupling of the mold to and from the machine frame without the necessity of manual manipulation of mounting bolts.

7 Claims, 4 Drawing Sheets

SELF-PROPELLED SLIP-FORM PAVING APPARATUS

BACKGROUND OF THE INVENTION

The present invention relates generally to paving-type construction equipment and, more particularly, to a self-propelled construction apparatus adapted to continuously slip-form a flowable paving material such as concrete into a predetermined cross-sectional shape along the ground or other base surface.

Self-propelled concrete paving machines of the general type indicated above are known, representative examples being illustrated and described in U.S. Pat. Nos. 4,789,266 and 4,808,026, which disclose multi-purpose paving machines that can pave roadways, as well as form curbs, gutters, spillways, sidewalks, troughs, barriers, and other continuous concrete extrusions depending upon the configuration of a mold supported by the machine.

One of the intended advantages of such machines is the selective ability to pave in a continuous slip-form manner a variety of differing cross-sectional configurations. In practice, however, the interchange of one mold for another has proven to be somewhat cumbersome and time-consuming, thereby preventing the intended advantage from being fully realized. In particular, the conventional machines provide an arrangement of mounting bolts on the machine frame to which each individual mold is adapted to be secured. Hence, in demounting an existing mold and mounting a replacement mold, several nut-and-bolt assemblies must be manually manipulated, including manual alignment of the new mold with the mounting bolts after removal of the mold originally in use.

SUMMARY OF THE INVENTION

It is accordingly an object of the present invention to provide an improved means for mounting and demounting a slip-form mold to a paving apparatus of the aforedescribed type which overcomes the disadvantages of conventional equipment by enabling more rapid interchange of molds with minimal requirement of manual labor.

Briefly summarized, the present invention is essentially adaptable to most any self-propelled construction apparatus of the type adapted for continuously slip-forming concrete or other flowable paving material into a predetermined cross-sectional shape along the ground or other surface. In accordance with the present invention, the apparatus basically comprises a frame, a suitable means for propulsion of the frame over the ground surface, appropriate means mounted to the frame for continuously depositing the paving material onto the ground surface during propulsion of the frame thereover, a mold configured for slip-forming the deposited paving material in the predetermined cross-section shape, and the improved means of the present invention for selectively mounting and demounting the mold to the frame to receive the paving material from the depositing means. In its most basic aspect, the mounting and demounting means of the present invention comprises at least one support member fixed to either the mold or the frame and at least one matable latching member movably attached to the other of the mold and the frame for selective movement between an unlatched position out of engagement with the support member for permitting mounting and demounting of the mold to and from the frame and a latched position engaging the support member to secure the mold to the frame in proper relation to the depositing means.

In the preferred embodiment, a pair of support members are affixed in spaced parallel relation to the mold and a pair of gripping levers are pivotably mounted to the frame for opposed movements toward and away from one another under the control of hydraulic actuators attached to each lever to drive their pivoting movements. In the latched position, the respective levers engage in latchways defined by the parallel support members to fix the mold to the frame. While the present invention is herein described in relation to a paving machine specifically set up to utilize a curbing mold, it will be understood by those persons skilled in the art that the salient features of the present invention are equally applicable to various other paving machines and various other paving applications utilizing other forms or configurations of molds.

DESCRIPTION OF THE PREFERRED EMBODIMENT

Figure 1:
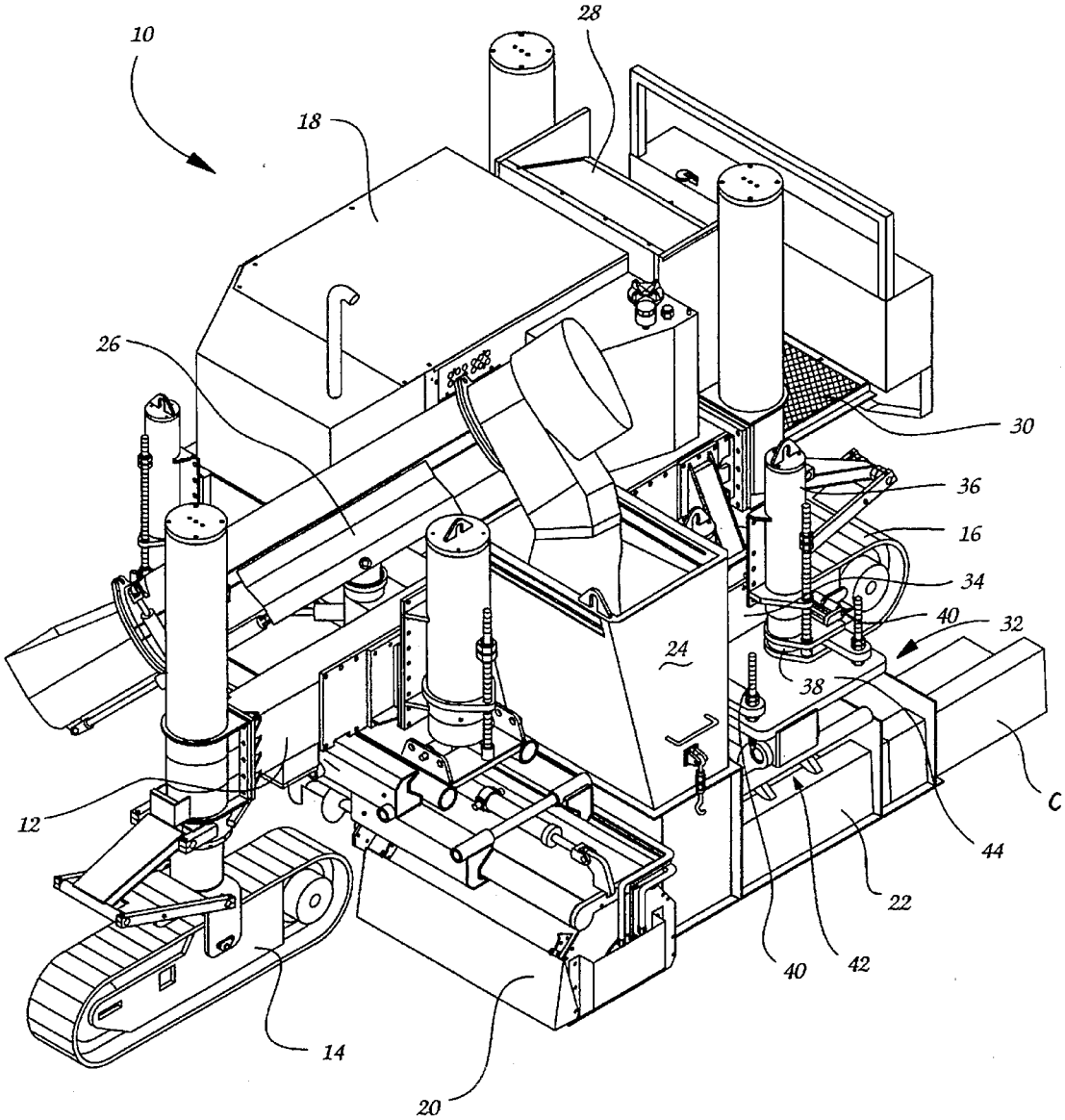
FIG. 1 is a front prospective view of a slip-form paving apparatus in accordance with the preferred embodiment of the present invention.
Figure 2:
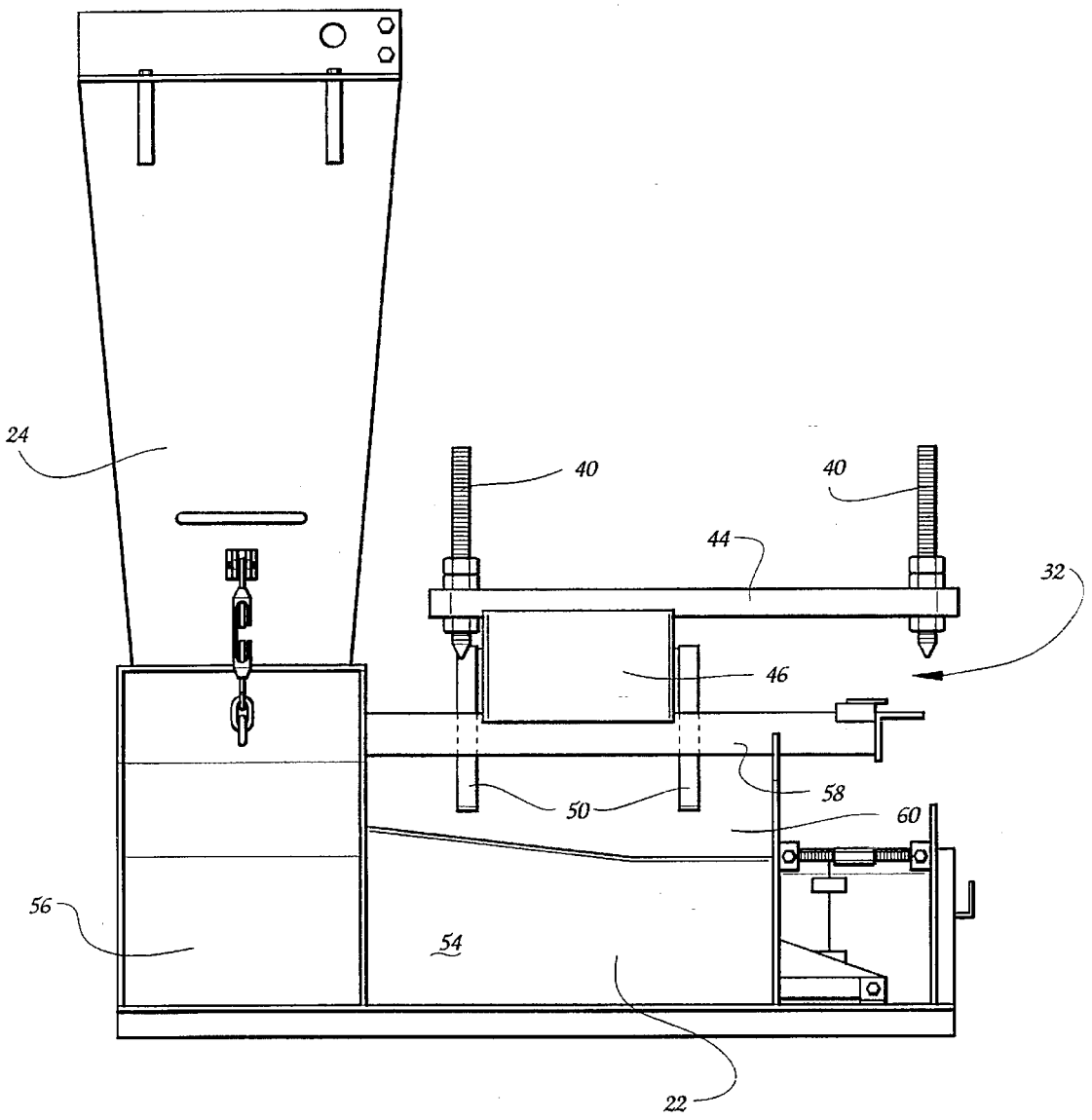
FIG. 2 is a partial left side elevational view of the paving apparatus of FIG. 1, depicting the concrete delivery and molding elements of the apparatus.

Referring now to the accompanying drawings and initially to FIGS. 1 and 2, a self-propelled slip-form paving apparatus in accordance with the present invention is indicated in its totality at 10. The paving apparatus 10 basically comprises a structural framework 12 supported substantially horizontally on front and rear drive assemblies 14,16, preferably in the form of so-called crawler assemblies of the endless track type. Preferably, a single front drive assembly 14 and a pair of rear drive assemblies 16 (only one of which is shown in FIG. 1) are mounted to the frame 12 in triangular relation to one another to provide stable suspension of the frame 12. An internal combustion engine 18 or other suitable self-contained power generator, preferably in conjunction with a hydraulic pump (not indicated), is mounted to the machine frame 12 to provide drive power to the crawler assemblies 14,16, preferably through individual hydraulic motors on each respective crawler assembly, and to otherwise supply operational power to the various systems of the paving apparatus.

The embodiment of the paving apparatus 10 depicted in the accompanying drawings is particularly adapted for the continuous slip-forming of a concrete curb such as typically formed along the sides of a roadway during road construction. However, as those persons skilled in the art will understand, the essential features and inventive concepts forming the present invention are equally well-adapted to substantially any form of self-propelled paving apparatus of the slip-form type wherein concrete or another flowable paving material is continuously deposited in a molded form according to a predetermined cross-sectional shape defined by a mold structure transported by the apparatus. Hence, is it is to be understood that the present invention is not limited to curb-paving machines but is equally susceptible to application in machines for slip-forming of roadways, gutters, spillways, sidewalks, troughs, barriers, and any other form of continuous concrete extrusion.

As will be understood, the ground surface on which the curb or other pavement is to be laid in molded form will be prepared in advance by suitable construction grading equipment. In order to provide a finish grade of the ground surface immediately in advance of the paving operation, the apparatus 10 is equipped with a trimmer structure, indicated only representatively at 20, at the forward end of the frame 12. Basically, the trimmer structure 20 includes a rotatably driven roller (not shown) having digging teeth projecting from its outer periphery for the purpose of partially digging into the ground surface to loosen and uniformly distribute the soil on which the pavement is to be formed. Additionally, the trimmer structure 20 includes a scraper blade (not shown) extending transversely across the rearward side of the digging roller to level the loosened soil. By way of example, the trimmer structure may be of the type described and illustrated in Clarke, Jr. et al U.S. Pat. No. 4,808,026 and Miller U.S. Pat. No. 4,197,032.

A suitable mold 22 is supported from the frame 12 (in a manner fully described hereinafter) immediately rearwardly of the trimmer structure 20. As previously indicated, the mold 22 is of a particular interiorly profiled configuration in the desired form of a roadway curb for purposes of representative illustration and description of an exemplary embodiment of the present invention. To best facilitate a curbing operation, the mold 22, along with the trimmer structure 20, is mounted at one side of the frame 12, although it will be understood that other molds may be centrally located in applications of the invention in other slip-form paving machines.

An upright concrete hopper 24 is mounted to the frame 12 in upstanding disposition above the mold 22 to provide a continuous supply of concrete or other suitable flowable pavable material into the mold interior. A concrete conveyor 26 extends angularly at an upward incline from the opposite side of the machine frame 12, terminating into the upward end of the hopper 24. In this manner, the hopper 24 can be continuously stocked with a suitable supply of concrete, e.g., from a concrete mixing truck (not shown) positioned to progressively feed concrete into the conveyor 26.

An operator control console 28 with an operator support platform 30 is mounted widthwise across the rearward end of the frame 12 in an elevated position from which an operator can view and control the various operating systems of the paving apparatus 10. As will be understood, once a supply of concrete is established into the hopper 24, the basic operation of the paving apparatus progresses by driving the crawler assemblies 13 to propel the apparatus 10 in a predetermined path of travel, whereby concrete from the hopper 24 is progresslively delivered into the mold 22 and, in turn, extruded from the rear of the mold 22 in the cross-sectional configuration of its internal profile, as representatively indicated in FIG. 1 by the curb C.

To the extent thus far described, the structure and operation of the paving apparatus 10 is essentially conventional. As already indicated, the present invention provides a novel means by which a mold or other form, such as the curb mold 22, may be quickly and easily mounted and demounted to and from the frame of such a paving apparatus with minimized manual effort. Conventionally, the mold 22, or such other mold or form as may be utilized for a particular paving application, is rigidly bolted directly to a portion of the machine frame. For example, as best seen in FIG. 1, the frame of the paving apparatus 10 is equipped with a mold suspending structure indicating in its totality at 32 supported at the side of the frame 12 at which the curb mold 22 is to be mounted. The mold suspending structure 32 has a subframe 34 affixed to a hydraulically-operated actuating mechanism (not shown) by which the subframe 34 may be selectively extended horizontally outwardly and inwardly relative to the lateral side of the frame 12 in a direction transverse to the normal forward direction in which the apparatus 10 travels. Further, a pair of vertically-oriented hydraulic cylinders 36 are mounted to the subframe 34 with mold-mounting brackets 38 affixed to their respective downwardly projecting pistons, each bracket 38 having a pair of vertical mounting bolts 40 to which the mold 22 would be affixed in a conventional mold-mounting arrangement. By this form of mold suspending structure 32, the apparatus 10 is enabled to selectively position the lateral and elevational dispositions of the mold 22 relative to the frame 12 and, in turn, to the ground surface so as to properly position the mold 22 for depositing and extruding the curb C.

Figure 3:
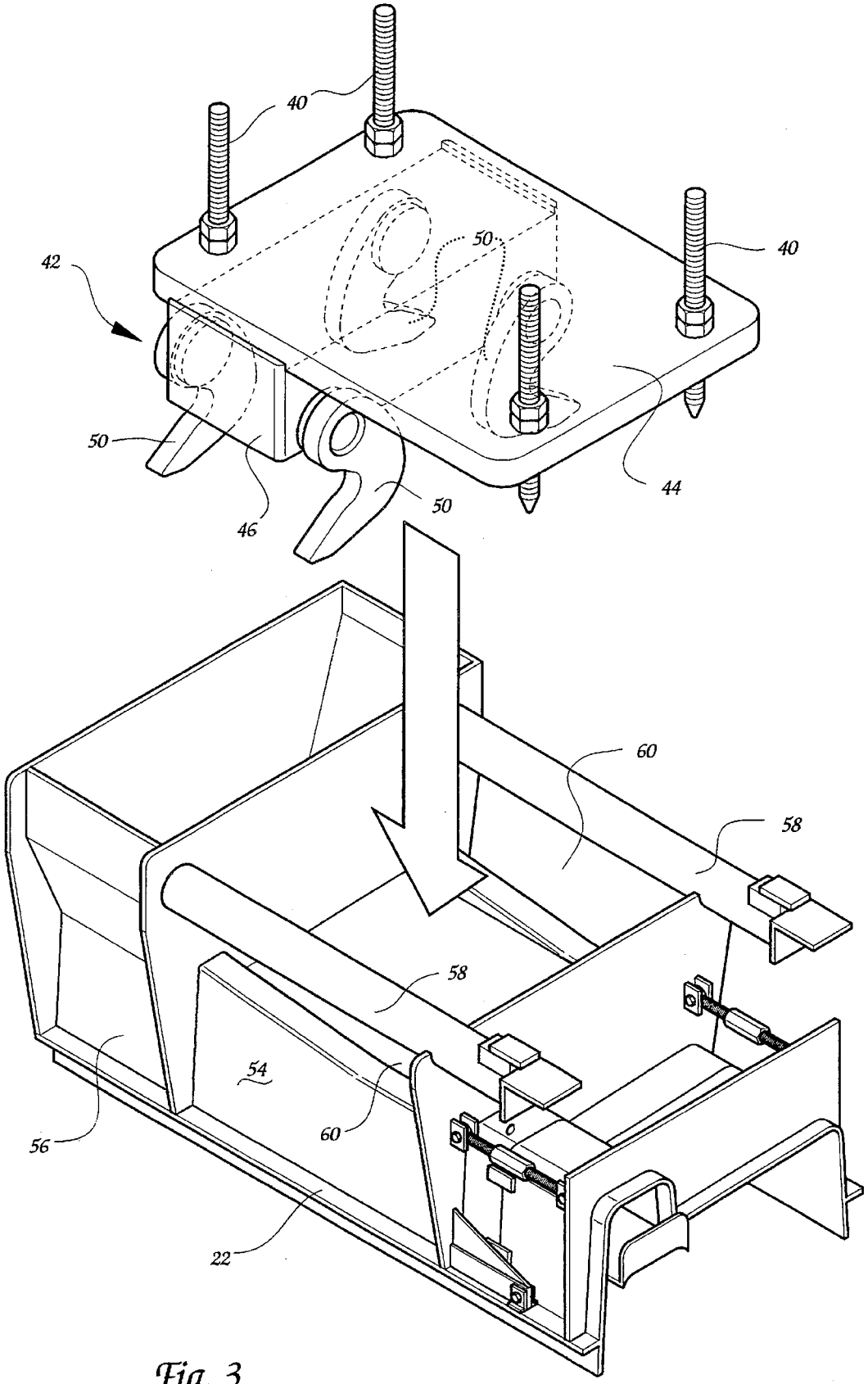
FIG. 3 is an exploded perspective view of the concrete delivery and molding elements of FIG. 2.

As seen in FIGS. 2 and 3, however, the present invention does not provide for direct bolting of the mold 22 to the vertical mounting bolts 40, but instead provides a novel pivoting latch mechanism, broadly indicated at 42, by which the mold 22 may be mounted to and demounted from the suspending structure 32 without manual manipulation of the bolts 40. Specifically, the latching mechanism 42 has a flat rectangular base plate 44 mounted in fixed horizontal disposition directly to the mounting bolts, with a latch housing 46 extending downwardly from the underside of the base plate 44.

Figure 4:
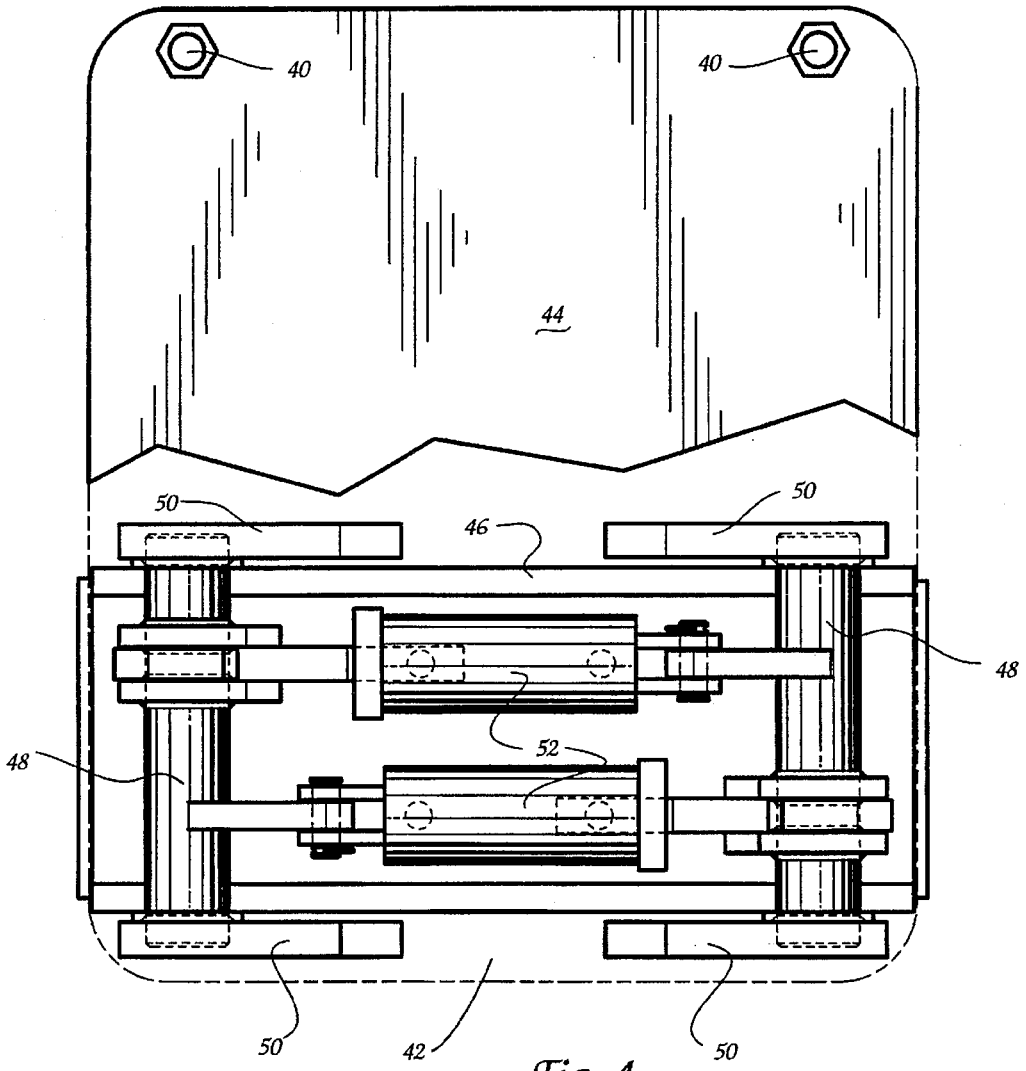
FIG. 4 is a top plan view of the mold-mounting structure of the present paving apparatus, taken along line 4—4 of FIG. 3.
Figure 5:
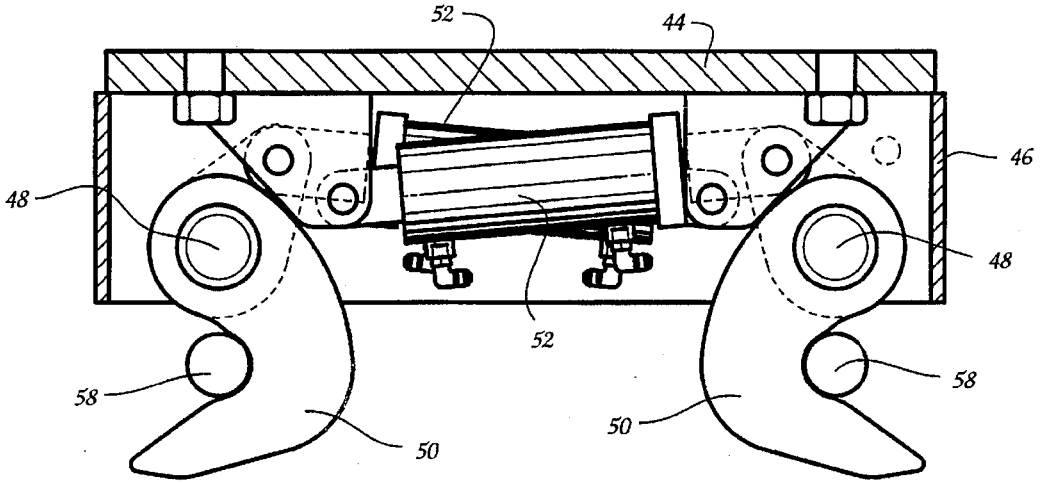
FIG. 5 is a vertical cross-sectional view of the mold-mounting structure of the present paving apparatus, taken along line 5—5 of FIG. 3.

As best seen in FIGS. 4 and 5, the latch housing 46 rotatably supports a pair of actuating shafts 48 in spaced parallel relation to one another extending lengthwise relative to the machine frame 12, with a pair of hook-shaped levers fixed to the opposite ends of each shaft 48. A pair of hydraulic cylinders 52 are mounted within the latch housing 46 in opposed relation to one another, the piston of each hydraulic cylinder 52 being affixed to a respective one of the operating shafts 48 so as to actuate rotational movement of the respective shaft 48 and, in turn, pivoting movement of the levers 50 at the ends of the shaft 48 through selective extension and retraction of the hydraulic cylinder's piston. Each hydraulic cylinder 52 is preferably of the double-acting type providing for both powered extension and retraction of the piston, the hydraulic lines being connected to the main hydraulic pump of the paving apparatus 10 and actuated through suitable controls on the operator console 28 to ensure synchronous coordinated extension and retraction of the hydraulic cylinders 52 and, in turn, synchronous coordinated pivoting of the respective latching levers 50.

The basic structure of the mold 22 is best seen in FIGS. 2 and 3 and basically comprises an upwardly opening concrete receiving chute 56 sized and configured to mate with the lower end of the concrete hopper 24, with a main mold body 54 merging with and extending rearwardly from the chute 56. As previously indicated, the main body 54 of the mold 22 is interiorly profiled in the cross-sectional shape desired for the curb C, the rearward end of the main mold body 54 being open for extrusion therethrough of the formed concrete as progressively traveling operation of the paving apparatus 10 proceeds in the manner aforedescribed. Such structural features of the mold 22 are essentially conventional.

To facilitate the ability of the mold 22 to be selectively coupled and decoupled to and from the latching mechanism 42, the mold 22 is provided with a pair of fixed cylindrical bars 58 mounted in parallel relation to one another lengthwise of the mold 22 and at a spacing above the outer upwardly-facing surface of the main mold body 54 to be engageable by the levers 50 of the latching mechanism 42. In particular, the lateral spacing between the cylindrical bars 58 substantially corresponds to the lateral spacing between the operating shafts 48 of the latching mechanism 42.

In this manner, by actuation of the hydraulic cylinders 52 to respectively pivot the latching levers 50 inwardly toward one another, the cylindrical bars 58 can freely pass upwardly and downwardly relative to the latching mechanism 42 without engagement by the levers 50 and, upon positioning of the bars 58 adjacent the underside of the latch housing 46, actuation of the hydraulic cylinders 52 to pivot the levers 50 outwardly causes the hooked ends of the levers 50 to extend through the latchways 60 defined between the bars 58 and the main mold body 54, thereby to securely engage and couple the mold 22 to the latching mechanism 42. Relative positioning of the mold 22 and the latching mechanism 42 in order to accomplish such mounting operation may be easily accomplished with the mold 22 resting on the ground surface by utilizing the hydraulic operating cylinders associated with the subframe 34 to position the latching mechanism 42 directly above the mold 22 and then to lower the latching mechanism 42 into position for latched coupling with the mold 22.

As will thus be understood, the novel latching mechanism 42 of the present invention uniquely enables a mold to be quickly mounted to the paving apparatus 10 and, when desired, to equally be quickly and easily demounted and replaced by another mold. Manual manipulation of the conventional mounting bolts 40 is completely eliminated beyond the initial mounting of the latching mechanism 42, where it will remain fixed in its mounted disposition. Further, manual labor in mounting and exchanging molds is minimized. Hence, the intended flexibility in utilizing a slip-form paving machine such as the apparatus 10 for multiple paving applications can best be realized through the use of the present invention. A further advantage is that the present invention can be equally adapted by retrofitting the latching mechanism 42 to existing machines with minimal modifications being necessary to the machines.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A self-propelled construction apparatus for continuously slip-forming a flowable paving material into a predetermined cross-sectional shape along a ground surface, the apparatus comprising a frame, means for propulsion of the frame over the ground surface, means mounted to the frame for continuously depositing the paving material onto the ground surface during propulsion of the frame thereover, a mold configured for slip-forming the deposited paving material in the predetermined cross-sectional shape, and means for selectively mounting and demounting the mold to and from the frame to receive the paving material from the depositing means, the mounting and demounting means comprising a support member fixed to the mold or the frame and a latching member movably attached to the other of the mold or the frame for selective movement between an unlatched position out of engagement with the support member for permitting mounting and demounting of the mold to and from the frame and a latched position engaging the support member to secure the mold to the frame and relative to the depositing means.

2. A self-propelled slip-form paving apparatus according to claim 1, wherein the latching member comprises a lever pivotally mounted to the said other of the mold or the frame and the support member defines a latchway into and out of which the lever moves between its latched and unlatched positions.

3. A self-propelled slip-form paving apparatus according to claim 2, wherein the lever is attached to the frame and the support element is attached to the mold.

4. A self-propelled slip-form paving apparatus according to claim 3, and further comprising means for selectively actuating pivoting movement of the lever between its latched and unlatched positions.

5. A self-propelled slip-form paving apparatus according to claim 4, wherein the mounting and demounting means comprises a pair of the support members affixed in spaced parallel relation to the mold and a pair of levers pivotably mounted to the frame for opposing movements toward and away from one another.

6. A self-propelled slip-form paving apparatus according to claim 5, wherein the actuating means comprises a hydraulic actuator attached to each lever to drive pivoting movement thereof.

7. A self-propelled slip-form paving apparatus according to claim 1, wherein the mold is configured to form a roadway curb.

* * * * *